United States Patent [19]

Johnson

[11] Patent Number: 4,520,514

[45] Date of Patent: Jun. 4, 1985

[54] FITTING FOR A SWIMMING POOL RETURN LINE

[75] Inventor: Bruce R. Johnson, Petaluma, Calif.

[73] Assignee: Jandy Industries, San Rafael, Calif.

[21] Appl. No.: 490,119

[22] Filed: Apr. 29, 1983

[51] Int. Cl.[3] ..... E04H 3/18

[52] U.S. Cl. ..... 4/490; 4/492; 4/541; 4/542; 134/167 R; 134/168 R

[58] Field of Search ..... 4/490, 492, 541, 542, 4/191, 310; 134/167 R, 168 R; 138/89

[56] References Cited

U.S. PATENT DOCUMENTS

| | | | |
|---|---|---|---|
| 779,904 | 1/1905 | Borman | 4/310 |
| 1,290,736 | 1/1919 | Greenberg | 4/191 X |
| 2,654,620 | 10/1953 | Tinnerman | 138/89 |
| 3,408,006 | 10/1968 | Stanwood | 134/167 R X |
| 3,521,304 | 7/1970 | Ghiz | 4/490 |
| 3,675,252 | 7/1972 | Ghiz | 4/492 |
| 3,952,956 | 4/1976 | Steele | 134/167 R X |
| 4,114,206 | 9/1978 | Franc | 4/490 |
| 4,195,371 | 4/1980 | Goodin | 4/490 |
| 4,241,464 | 12/1980 | Buckwalter | 4/492 X |
| 4,248,271 | 2/1981 | Burgess | 138/89 |
| 4,349,923 | 9/1982 | Chalberg | 4/542 |
| 4,438,537 | 3/1984 | Bickle | 4/492 |

*Primary Examiner*—Henry K. Artis

*Attorney, Agent, or Firm*—Melvin R. Stidham

[57] ABSTRACT

A fitting for a swimming pool return line comprising a housing with a cylindrical extension that may be inserted into the return line and an outer end closure in which the main nozzle is swiveled for directional control of surface circulation. A slot in the bottom of the housing is of adjustable size for bottom circulation. The fitting is secured in place by pulling sloping, radial legs toward planar disposition which would bear against the inner surface of the return line.

4 Claims, 3 Drawing Figures

FITTING FOR A SWIMMING POOL RETURN LINE

BACKGROUND OF THE INVENTION

Most swimming pools are provided with circulation systems wherein water is pumped from the pool through a filtering system and then returned to the pool through one or more return lines, often flowing through a boiler or solar heating system prior to the return. Generally, the return lines are directed parallel to the water surface to generate a surface circulation pattern. With the increased popularity of automatic pool cleaners, it has been determined that the cleaning potential is enhanced by directing the water from the return line down the sides of the pool to the floor but, unfortunately, this detracts from the efficiency of surface circulation.

There are available for mounting in the outlet end of a return line various types of nozzles, some of which have directional controls. Such fittings are generally threaded into the return line and, therefore, require that the return line be threaded to receive the fixture. Other fixtures are secured in place by bonding, but they are not readily removable.

OBJECTS OF THE INVENTION

It is an object of this invention to provide a fixture for a swimming pool return line that provides both surface and bottom circulation.

It is a further object of this invention to provide a fitting for a pool return line that jets a stream of adjusted capacity down the side of the pool.

It is a further object of this invention to provide a fitting for a pool return line that is easily installed and replaced without requiring a threaded connection.

It is a further object of this invention to provide a fitting for a pool return line that projects a directionally adjusted stream for improved surface circulation.

Other objects and advantages of this invention will become apparent from the description to follow, particularly when read in conjunction with the accompanying drawing.

SUMMARY OF THE INVENTION

In carrying out this invention, there is provided a housing with a generally cylindrical extension that may be inserted into the pool return line. Radial legs that normally angle outward in conical disposition to a central ring are flexed inward toward a plane normal to the axis, causing them to bear firmly against the inner wall of the return line and secure the fitting in place. A spherical nozzle is rotatable in the outer wall of the fitting and may be turned for directional adjustment of the stream. A narrow slot in the bottom of the housing, which may be of adjusted arcuate length, directs a stream downward along the wall of the pool for bottom circulation.

DESCRIPTION OF A PREFERRED EMBODIMENT

Figure 2:
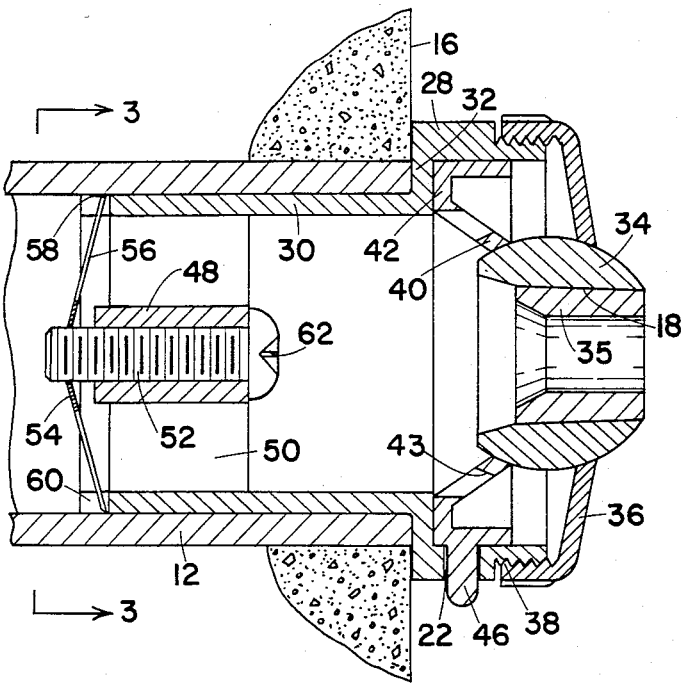
FIG. 2 is an enlarged vertical section view of the fitting.
Figure 3:
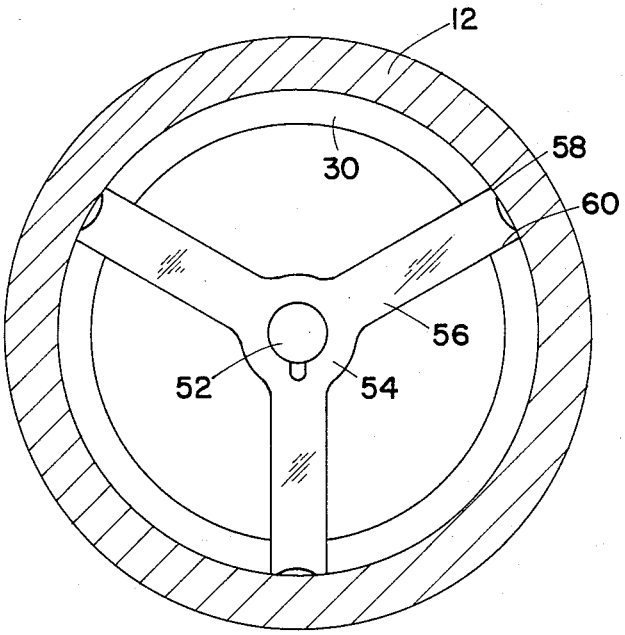
FIG. 3 is a section view taken along line 3—3 of FIG. 2.
Figure 1:
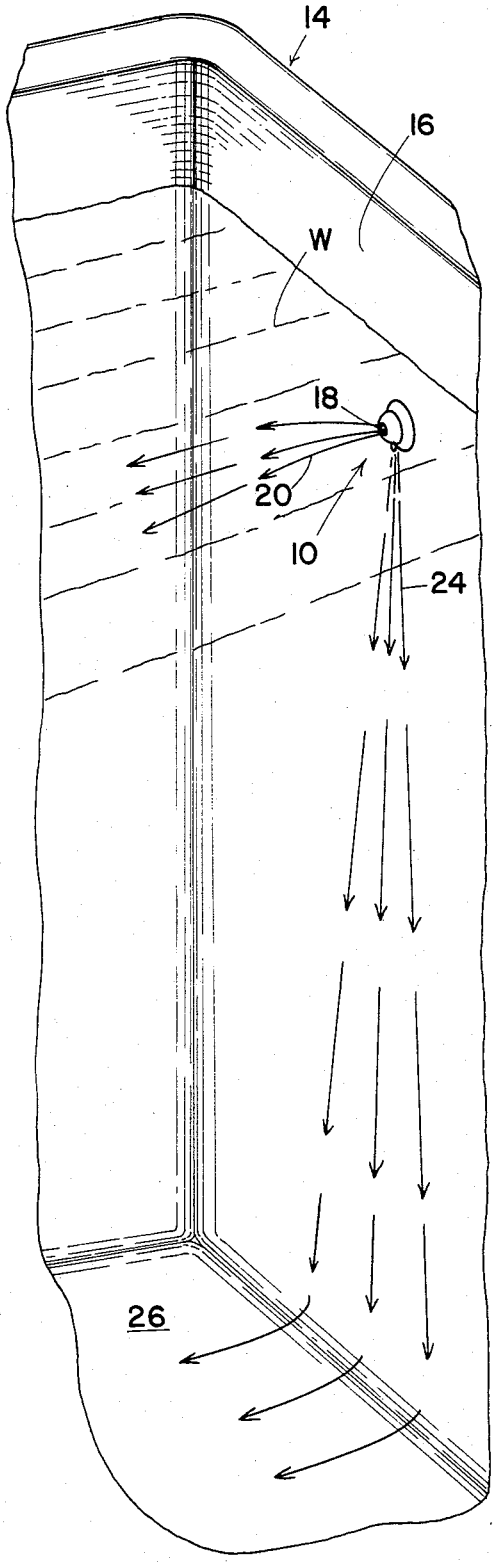
FIG. 1 is a view in perspective of a swimming pool with the fitting of this invention installed.

Referring now to the drawings with greater particularity, the dual return nozzle 10 of this invention is mounted in the return line 12 (FIG. 2) of a swimming pool 14 so as to extend from a wall 16 thereof. The fitting 10 has a main water outlet 18 that projects a stream 20 outward along the surface of the water W for surface circulation, and a narrow bottom slot 22 (FIG. 2) that projects a stream 24 downward along the side 16 to generate circulation along the bottom 26.

The dual nozzle fitting comprises a housing 28 with an inner cylindrical extension 30 that fits snugly into the return line 12 with an annular flange 32 abutting against the sides 16 of the pool.

The main water outlet 18 is formed in a sphere 34 that is rotatably carried in complementary spherical surfaces formed in an end closure 36, which is threaded at 38 onto the housing 28, and in a conical extension 40 from a rotatable arcuate gate 42, with openings 43 therein for water flow to the slot 22. Hence, the spherical nozzle 34 may be turned to any desired position for controlling the direction of the stream 20 and secured in place by tightening the end closure 36 onto the body or housing 28. The main outlet 18 is tapered slightly and a complementary tapered reduction sleeve 35 of a selected size may be inserted if desired.

The slot 22 is formed in the bottom of the housing 28 and the arcuate closure member 42 may be snapped into the housing 28 so that an adjustment handle 46 extends through the slot 22. Hence, the arcuate closure 42 may be rotated within the housing to adjust the effective size of the slot opening 22.

A central collar 48 is coaxially positioned within the housing sleeve 32 by means of radial legs 50 to be aligned with the main outlet 18. A screw 52 extending through the collar 50 is threaded into a ring 54 that carries a series of thin radial legs 56 with relatively sharp ends 58 that slide in slots 60 formed in the inner end of the cylindrical extension 30. Hence, when the screw 52 is turned by inserting a screwdriver through the main outlet 18 and into the usual groove 62 in the head of the screw 53, the ring 54 and legs 56 are pulled forward, causing the legs 56, and particularly the sharp ends 58 to bite firmly into the inner wall of the return line 12 and hold the fitting 10 firmly in place.

To install the fitting 10, the end closure 36 may be loosened somewhat and the cylindrical extension 30 inserted into the return line 12. Then, a screwdriver is inserted through the main flow passage 18 to turn the screw 66 and pull the second sleeve forward causing the legs 56 to grip radially the inner surface of the return line 12 and lock the fitting in place. Then, after the spherical nozzle 34 is turned to the desired position for direction control of the stream 20, the end closure 36 is threaded tightly to bear against the surface of the nozzle 34 to lock it in its fixed position.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed is:

1. A fitting for a swimming pool return line having an outlet end near the surface of the pool comprising:

a generally cylindrical housing;

a cylindrical extension on one end of said housing receivable in the outlet end of said return line to be secured therein;

an end closure on said other end of said housing;

a nozzle centrally located on said end closure, and a flow passageway through said nozzle to direct a jet of water outward;

said nozzle being movable in said end closure for directional adjustment of said flow passageway;

an arcuate slot in the lower portion of said housing to jet a sheet of water downward along a wall in which said housing is mounted; and an arcuate closure member movable in said housing between a closed position wherein said slot is covered and a full open position wherein flow through said slot is unimpeded.

2. The fitting defined by claim 1 including:

means for securing said nozzle in an adjusted portion in said end closure.

3. The fitting defined by claim 1 including:

a centrally disposed ring in said cylindrical extension;

at least two radial legs on said ring with the ends thereof adapted to engage the inner surface of said return line;

said legs being disposed at an angle to a radial plane of said return line; and means for pulling said ring forward to force said legs toward said radial plane to increase bearing pressure against the inner surface of said return line.

4. The fitting defined by claim 3 wherein:

said last-named means includes a threaded member carried coaxially in said cylindrical extension; and said main water outlet is substantially aligned with said threaded member to provide access thereto.

* * * * *